US006427482B1

(12) United States Patent
Lösche et al.

(10) Patent No.: US 6,427,482 B1
(45) Date of Patent: Aug. 6, 2002

(54) DEVICE FOR INTRODUCING $CO_2$ SNOW INTO CONTAINERS IN ORDER TO COOL THE CONTENT OF SAID CONTAINERS OR TO COOL THE CONTAINERS THEMSELVES

(75) Inventors: Klaus Lösche; Gerhard Dirksen; Ralf Wiesmann, all of Bremerhaven; Dirk Sikken, Brmen, all of (DE)

(73) Assignee: Craft Tech gbr, Bremerhaven (DE)

( * ) Notice: Subject to any disclaimer, the term of this patent is extended or adjusted under 35 U.S.C. 154(b) by 0 days.

(21) Appl. No.: 09/674,727

(22) PCT Filed: May 10, 1999

(86) PCT No.: PCT/DE99/01437

§ 371 (c)(1),
(2), (4) Date: Dec. 20, 2000

(87) PCT Pub. No.: WO99/58913

PCT Pub. Date: Nov. 18, 1999

(30) Foreign Application Priority Data

May 8, 1998 (DE) ..... 198 20 588

(51) Int. Cl.[7] ..... F25J 1/00
(52) U.S. Cl. ..... 62/603
(58) Field of Search ..... 62/603

(56) References Cited

U.S. PATENT DOCUMENTS 3,786,644 A * 1/1974 Rich et al. ..... 62/603
3,861,168 A 1/1975 Sayers
3,952,530 A * 4/1976 Tyree, Jr. ..... 62/603
4,415,346 A 11/1983 Love
5,657,642 A 8/1997 Reznikov et al.

FOREIGN PATENT DOCUMENTS

| | | |
|---|---|---|
| DE | 197 16 844 | 12/1998 |
| EP | 0 714 606 | 10/1995 |
| FR | 2.211.633 | 7/1974 |
| FR | 2 253 193 | 6/1975 |
| WO | WO 94/00712 | 1/1994 |

* cited by examiner

*Primary Examiner*—Ronald Capossela
(74) *Attorney, Agent, or Firm*—Schiff Hardin & Waite

(57) ABSTRACT

Apparatus for the introduction of $CO_2$ snow into containers for cooling the container contents or the container, comprises a $CO_2$ snow generating device for generating the $CO_2$ snow, a $CO_2$ snow injection device connected to the $CO_2$ snow generating means and having a snow tube for injecting the generated $CO_2$ snow into the container, a the $CO_2$ gas separating arrangement for separating $CO_2$ gas and $CO_2$ snow in the region of the snow tube, and the $CO_2$ gas extraction arrangement for extracting separated the $CO_2$ gas, the $CO_2$ gas separating arrangement comprises an outer tube surrounding the snow tube and arranged coaxially with the outer tube projecting beyond the snow tubed in longitudinal direction thereof at the $CO_2$ snow delivery side of the snow tube and being connected to the $CO_2$ gas extraction arrangement in the region of the opposite side.

20 Claims, 6 Drawing Sheets

DEVICE FOR INTRODUCING $CO_2$ SNOW INTO CONTAINERS IN ORDER TO COOL THE CONTENT OF SAID CONTAINERS OR TO COOL THE CONTAINERS THEMSELVES

BACKGROUND OF THE INVENTION

The present invention is directed to an apparatus for introducing $CO_2$ snow into containers for cooling the container contents or the container. The apparatus has a $CO_2$ snow-generating means for generating $CO_2$ snow, a $CO_2$ snow injection means connected to the $CO_2$ snow generating means a snow tube for the injection of the generated $CO_2$ snow into the container, a $CO_2$ gas separating means for the separation of $CO_2$ gas and $CO_2$ snow in the region of the snow tube and a $CO_2$ gas extraction means for extracting separated $CO_2$ gas. What is to be understood here by generating $CO_2$ snow is that conditions are created whereat $CO_2$ snow arises.

In many technical processes, the product to be processed must have its temperature maintained within a specific range in order to avoid damage to or poorer workability of the product. Due to the introduction of mechanical energy, for example in the form of mixing or homogenizing, the temperature in the container rises and, thus, so does the temperature of the product. Some materials exhibit low thermal conductivity, a great layer thickness, a high viscosity or other properties during the processing process that require a direct cooling. When producing doughs in a bakery, for example, the temperatures are to be kept as constant as possible in the range from 23° C. through 30° C. (for example, 24° C.+/−0.5° C.) dependent on the various types of baked goods in order to be able to govern the biological, enzymatic and chemical processes so that the processes, which are critical for the dough preparation are undiminished. Even temperature fluctuations of 1 through 2° C. already lead to significantly modified product properties. The reasons for this include the narrow temperature optimum of the enzymes contained therein as well as of the added baker's yeast. Thus, the respiratory activity and, thus, the $CO_2$ formation rate of the yeast is directly dependent on the process temperature. The dispersion of the solids, the gas solubility, the gas pressure, the plastic, elastic and viscous properties are also influenced by the temperature. Up to now, water in the form of faked, cracked or chipped ice was often utilized for direct cooling. This cooling method, however, has a physical limit since the proportion of water in the product is also raised due to intensified cooling. Due to the predetermined proportion of water in the product, water as ice can be added only maximally on this order of magnitude. Whereas to 100% of the added water can be added as ice in a butcher shop during the process of cutting, only 10 through 20° of the added water can be added as ice in a bakery, since the remaining part must already be present as a liquid (rising, stabilization) at the beginning of the dough structuring (working).

A direct cooling of raw materials, intermediate and final products requires an innocuous nature of the coolant in the product to be processed not only in the food stuffs field but also in the field of pharmaceutics and cosmetics. It is also important that no dilution or some other modification of the concentrations as is possible given a direct cooling with water as ice occurs in the product due to the cooling process. A direct cooling with $CO_2$ snow meets these criteria.

As a result of the employment of $CO_2$ snow in the direct cooling of the product, the energy transport can be decoupled from the amount of water utilized. Since a great deal of energy is withdrawn from the product (for example dough) due to the high evaporation enthalpy of the $CO_2$ in the phase transition from a solid to a gaseous phase (sublimation), a direct cooling with $CO_2$ snow is thus very efficient. Due to an enrichment of $CO_2$ in the gas phase, however, a reduction of the partial oxygen pressure in the head space of the container occurs. A specific partial oxygen pressure is necessary, for example in dough production, for the processes of oxidative solidification of the adhesive lattice due to the interaction of thiol and disulfide groups. As a result of the extraction of the gaseous $CO_2$ from the head space, the necessary partial oxygen pressure for assuring these oxidative processes can be adhered to.

The known apparatus cited at the outset exhibits the disadvantage that devices that are already present such as, for example, dough agitators can be refitted with a dough or, respectively, container cooling only with relatively great structural outlay.

SUMMARY OF THE INVENTION

The invention is thus based on the object of developing the known apparatus to the effect that already existing devices can be easily retrofitted with a dough or, respectively, container cooling.

This object is inventively achieved in that the $CO_2$ gas separating means comprises an outside tube that surrounds the snow tube and is coaxially arranged thereto that projects beyond the snow tube in a longitudinal direction thereof at the $CO_2$ snow output side of the snow tube and that is connected with the $CO_2$ gas extraction means in the region of the opposite side.

It can thereby be provided that the $CO_2$ snow generating means comprises a delivery means for conducting liquid $CO_2$ and an evaporation means for the evaporation of the liquid $CO_2$.

Beneficially, the evaporation means is arranged in the region of that side of the snow tube lying opposite the $CO_2$ snow delivery side.

The evaporation means advantageously comprises a nozzle.

Beneficially, the snow tube and the outer tube end in the head space of the container.

It can also be provided that the snow tube and the outer tube are vertically arranged.

On the other hand, it can also be provided that the snow tube and the outer tube are arranged at such an angle that the $CO_2$ snow drops into the container.

Beneficially, the snow tube is widened at the $CO_2$ snow delivery side. A more uniform output of the $CO_2$ snow into the container is thus assured.

It can also be provided that the outer tube is widened at its end located at the $CO_2$ snow delivery side of the snow tube.

In particular, it can be provided that the snow tube and/or the outer tube is/are conically fashioned.

Beneficially, the extraction means comprises a ventilator.

According to another particular embodiment, the apparatus is characterized by a temperature control means for regulating the temperature of the container content or of the container itself by the injection of a corresponding quantity of the $CO_2$ snow.

In particular, it can thereby be provided that the temperature control means comprises a rated temperature input means, a temperature sensor for measuring the actual temperature of the container content, a temperature comparison means for comparing the actual temperature to the rated temperature as well as a drive means for driving a valve arranged in the supply conduit for the liquid $CO_2$.

Another particular embodiment of the invention is characterized by an oxygen partial pressure regulating means for regulating the partial oxygen pressure in the head space of the container by extracting a corresponding quantity of the $CO_2$ gas.

Alternatively, a particular embodiment can be characterized by a carbon dioxide partial pressure regulating means for regulating the partial carbon dioxide pressure in the head space of the container by measuring the partial carbon dioxide pressure and extracting a corresponding quantity of the $CO_2$ gas. Compared to the embodiment with oxygen partial pressure regulating means, the $CO_2$ gas part is directly measured in this embodiment.

Finally, it can be provided that the container is a container for kneading bread or cake dough.

The invention is based on the surprising perception that the concentric arrangement of the snow tube and the surrounding outer tube of the separating means results merely in a double tube and, thus, a structural intervention for passing the double tube through need only be undertaken at one location of the container cover for retrofitting existing devices with the dough or container cooling. Over and above this, the snow tube that is shorter compared to the outer tube enables an extraction of the $CO_2$ not converted into $CO_2$ snow before the $CO_2$ gas enters into the container at all, which enables a better monitoring and setting of the partial oxygen pressure in the head space of the container and, further, prevents a displacement of the oxygen as well as an introduction of the $CO_2$ gas into the product located in the container as well as contact therewith. Due to the cyclone effect, moreover, the inventive apparatus exhibits an extremely high $CO_2$ snow generating efficiency that nearly corresponds to the theoretical efficiency of 60%. The $CO_2$ gas extraction means, in combination with the outer tube, can also be employed after the $CO_2$ snow injection phase to extract the $CO_2$ gas subsequently formed with the $CO_2$ snow. The inventive apparatus thus enables an especially good cooling of the reaction processes with the cold content of the $CO_2$ snow without the product to be cooled coming into contact with the $CO_2$ gas to any noteworthy extent and being thus damages.

Examples of reaction processes in food stuff manufacture wherein the inventive apparatus can be utilized are:

1. Kneading wheat products: a process that must be essentially aerobic and oxidative and whereat additional frictional heat must be eliminated (reaching a specific dough temperature, for example 24.0° C.). If the $CO_2$ gas were to proceed into the dough, the necessary oxidation of the gluten proteins (the thiol groups in the proteins remain in the reduced condition) could, among other things, not occur and the desired dough development would be greatly reduced. A corresponding dough would not be elastic, would be discolored gray and the quality of the baked product would be extremely deteriorated.

2. Fermentation liquors: aerobic fermentations (for example, yeast production) require oxygen. At the same time, heat must be eliminated as a consequence of the metabolic action. When the $CO_2$ gas in increased concentrations proceeds into the medium, the cell changes to an anaerobic metabolism, with the result that its reproduction is retarded or suspended (Pasteur effect). The consequences may be dramatic yield losses in terms of biomass. In another instance, fermentation formulas must be rapidly cooled from the fermentation temperature to a storing temperature or processing temperature (sour dough). The introduction of excessive quantities of the $CO_2$ gas in the sour dough ($CO_2$ solubility rises dramatically with low temperature) deteriorates the sensory (stifling smell and taste), hygienic (risk of the growth of aneroid bacteria) and the Theological properties (increased flowing). In the case of wheat sour doughs, oxidation processes are additionally minimized, important pigments are not formed (carotenoids) or protein SH groups are impeded in terms of their oxidation.

3. Fruit and vegetable processing: peeled apples or peeled potatoes but also salads (iceberg salad, etc.) can be preserved by water emersion baths (low-pressure container) specifically saturated with the $CO_2$ snow. As a result thereof, an employment of preservatives (sulfites, etc.) can be avoided. The objective is, on the one hand, to introduce $\geqq 7.0$ g $CO_2$/kg water and, on the other hand, to exploit the cooling effect. The high $CO_2$ concentration enables both antimicrobial effects (reduction in the number of germs) as well as the minimization of enzymatic processes ("enzymatic browning" due to phenoloxidases) due to $O_2$ displacement, and the like. The necessary $CO_2$ concentration given simultaneous cooling effect can be achieved by dry ice ($CO_2$ snow). The extraction of the $CO_2$ gas is therefore also required for this process.

4. Grain mashes: in a malt house, grain is caused to germinate in germination boxes or the like at high water contents and elevated temperature (approximately 5 through 7 days). Cooling these mashes down to further-processing or, respectively, storing temperature dare not change the water content of the mashes and should be as fast as possible (due to the microbial risks) but without any $CO_2$ gas (in order to avoid anaerobic processes for avoiding disadvantageous solubilization or extraction processes as well that occur due to the $CO_2$ gas in solution). In a similar application, what are referred to as "brew batches" (cooked grain) in a bakery can be very rapidly cooled to further-processing or, respectively, storing temperature without changing the dough yield (water content) and without introduction of the $CO_2$ gas.

5. Emulsifiers: the production of emulsions (water in oil, oil in water, multi-phase emulsions) requires the introduction of mechanical energy to a high degree with the assistance of specific homogenizing apparatus. The elimination of the frictional heat, the emulsification at defined temperatures and aerobic conditions (for example, 15° C.) are critical pre-requisites for the reaction management. A displacement of air oxygen during the reaction by the $CO_2$ gas would modify the reactivities at the phase boundary surfaces and would jeopardize the emulsification goal.

6. Raw meat mass: the production of raw meat mass ensues in the cutting house. For this process, great quantities of frictional heat (comminution work) must be eliminated and, on the other hand, work must be carried out at low temperature (for example +4° C.) for hygienic aspects and technological reasons. The introduction of $CO_2$ gas, in contrast ($CO_2$ solubility in water-containing and high-protein sausage mass) is undesirable and leaves to hygienic, technological (consistency, etc.) and sensory disadvantages.

The inventive apparatus can also be of great assistance in maintaining the cooling chain when transporting food stuffs and other sensitive materials. With the assistance of non-stationary apparatus, for example, a suitable insulating container can be very easily "snowed" with the $CO_2$ snow. When this is carried out at the upper part of the container, a uniform distribution of the snow from top to bottom occurs, and this causes a very uniform distribution on the repackaged food stuffs (cartons, etc.). As a result thereof, the desired transport or intermediate storing temperature of, for example, 18° C. can be maintained over a long time (for example eight hours). Here, too, the active removal of the $CO_2$ gas arising "in statu nasceni" is necessary in order to assure adequate worker protection and working security (the enrichment of $CO_2$ gas in the environment is intolerable for reasons of worker safety). When unpackaged food stuffs are to be cooled and transported in the insulated container (for example, open cream products, bakery products with unbaked filling, baked goods, sausages, etc.), then snowing with dry ice can ensue. $CO_2$ gas (water as well) is to be avoided here, first in order to prevent a quality change of the product (taste, color etc.) and, on the other hand, in order to adhere to work protection and work safety.

Further features and advantages of the invention derive from the claims and the following description, wherein an exemplary embodiment is explained in

BRIEF DESCRIPTION OF THE DRAWINGS

A detail on the basis of drawings.

DESCRIPTION OF THE PREFERRED EMBODIMENTS

Figure 1:
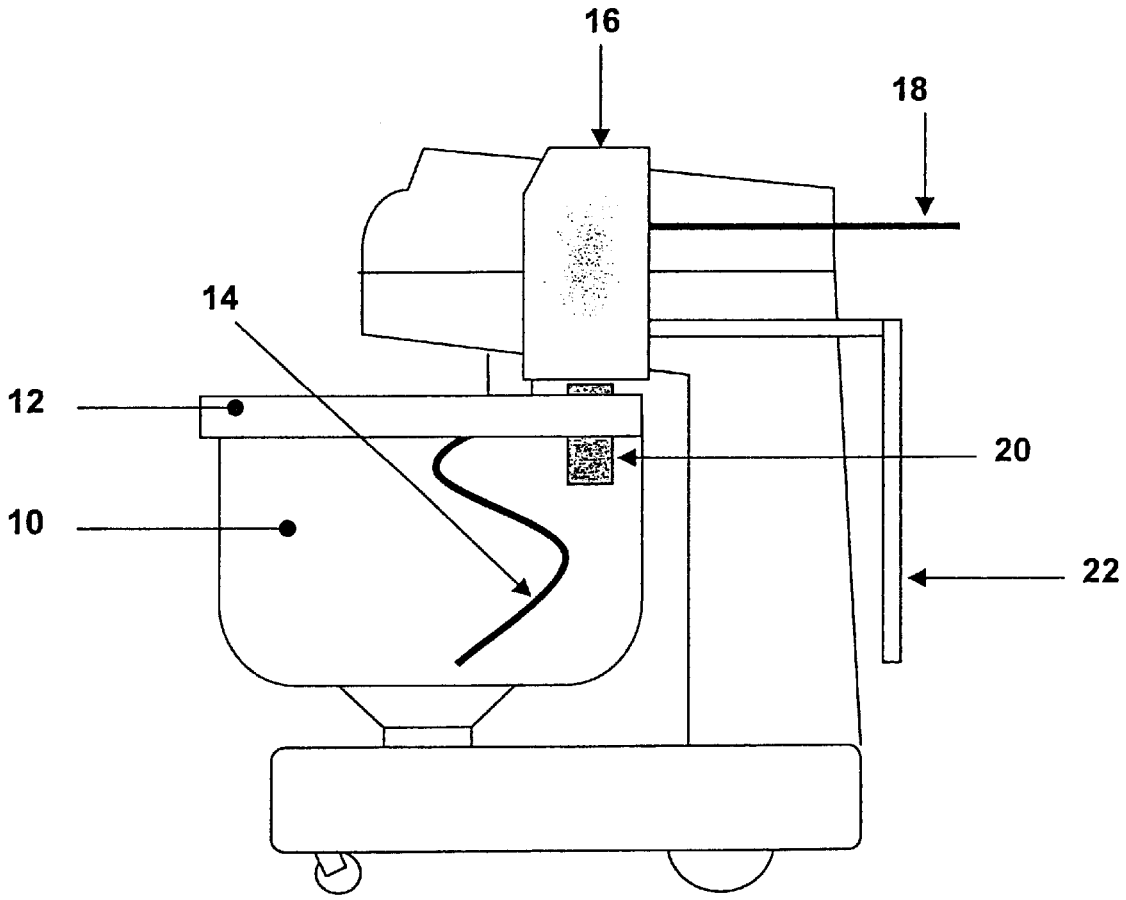
FIG. 1 is a shematic side view of a dough kneading mache with a specific embodiment of the inventive apparatus whereby the kneading container of the dough kneading machine is shown to be transparent.

FIG. 1 shows a dough kneading machine with a kneading container 10, a container cover 12 and a kneading arm 14. A specific embodiment of the inventive apparatus 16 is located next to the kneading arm 14 for introducing a $CO_2$ snow into the kneading container 10 for cooling a bread dough (not shown) situated in the kneading container 10. The inventive apparatus 16 comprises a delivery conduit 18 for delivering a liquid $CO_2$, an outer tube 20 with an inner snow tube (not shown) for injecting the $CO_2$ snow produced in the apparatus 16 into the kneading container 10 as well as an exhaust gas conduit 22 for eliminating the $CO_2$ gas.

Figure 2:
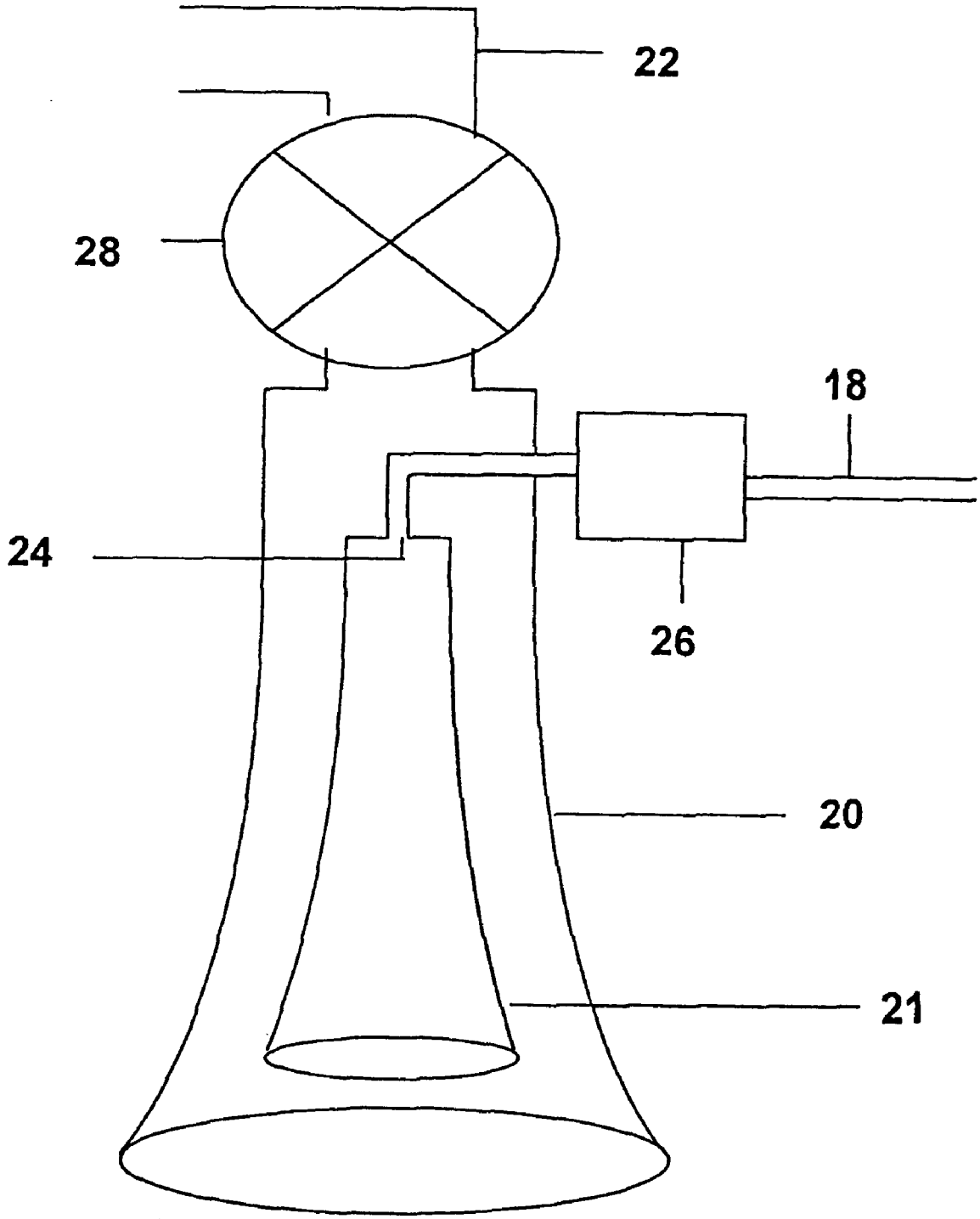
FIG. 2 is a diagrammatic partial side view of the dough kneading machine of FIG. 1 that shows the specific embodiment of the inventive apparatus in detail.

FIG. 2 shows details of the inventive apparatus 16 of FIG. 1. A coaxially arranged snow tube 21 is located in the outer tube 20, the upper end thereof being 20 connected with the supply line 18 via a nozzle 24 and a solenoid or solenoid valve 26. The outer tube 20 and the snow tube 21 are comically fashioned, whereby the cross-sections of the outer tube 20 and of the snow tube 21 increase toward the $CO_2$ snow delivery side of the snow tube 21. The upper end of the outer tube 20 is connected via a ventilator 28 to the exhaust gas conduit 22. The lower end of the outer tube 20 projects beyond the end of the snow tube 21 in a longitudinal direction.

Figure 3:
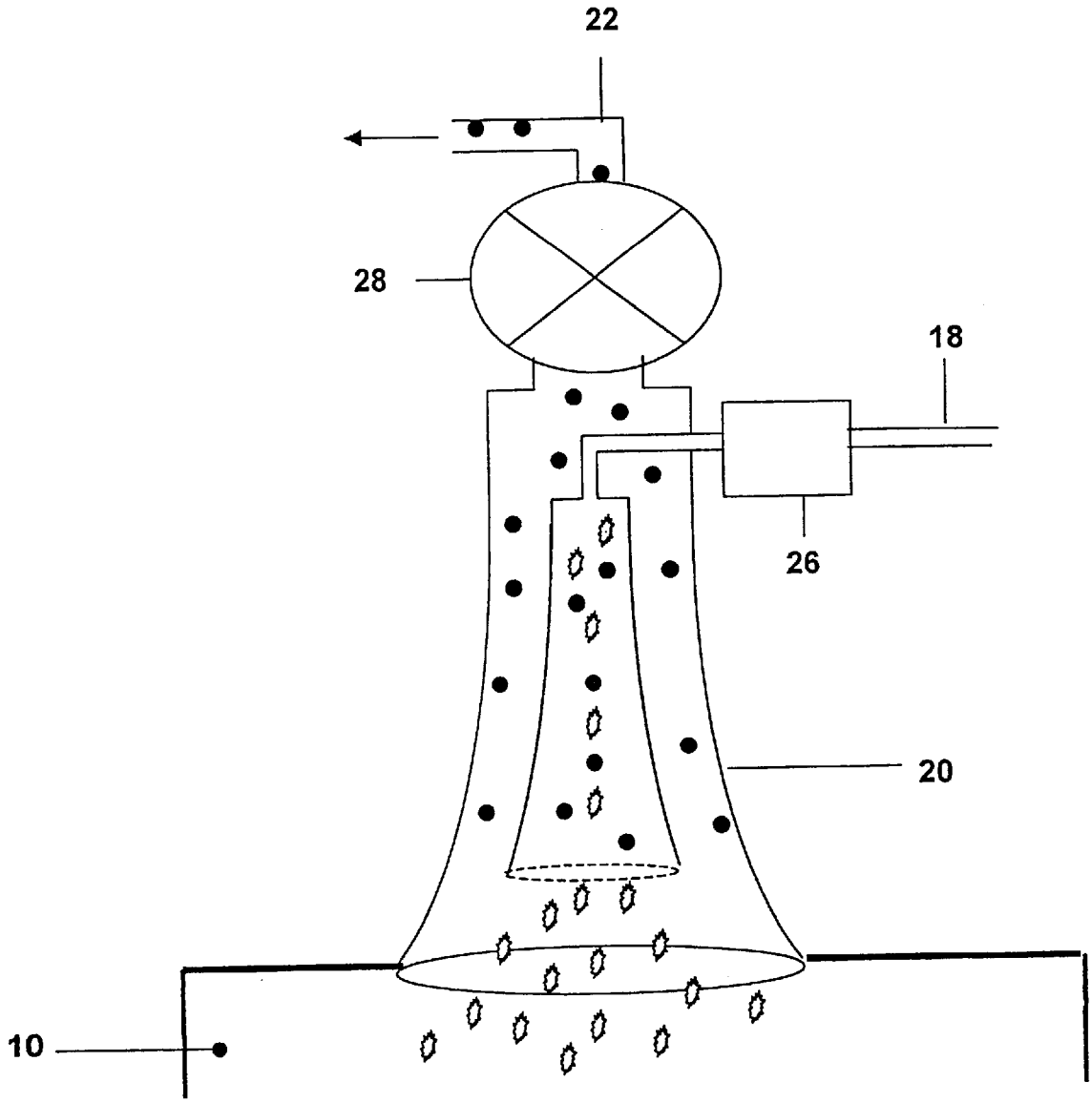
FIG. 3 is a diagrammatic view of the apparatus of FIG. 2 at the point in time of the $CO_2$ snow production.

FIG. 3 shows the inventive apparatus during the production of $CO_2$ snow. Liquid $CO_2$ is injected through the nozzle 24 into the snow tube 21 via the supply line 18 and a corresponding drive of the solenoid or solenoid valve 26. As a result of relaxation, the aggregate state of the liquid $CO_2$ changes and the $CO_2$ snow (identified by flakes) and the $CO_2$ gas (identified by black dots) arise. The $CO_2$ snow serves the purpose of direct cooling of the bread dough in that it sediments and absorbs heat from the kneading container 10 and the bread dough located therein. Given this heat transmission, the $CO_2$ snow converts into the gaseous phase. The $CO_2$ gas that emerges from the snow tube 21 simultaneously with the production of the $CO_2$ snow is suctioned up by the ventilator 28 in the suction direction identified by the arrows and is eliminated via the exhaust gas conduit 22.

Figure 4:
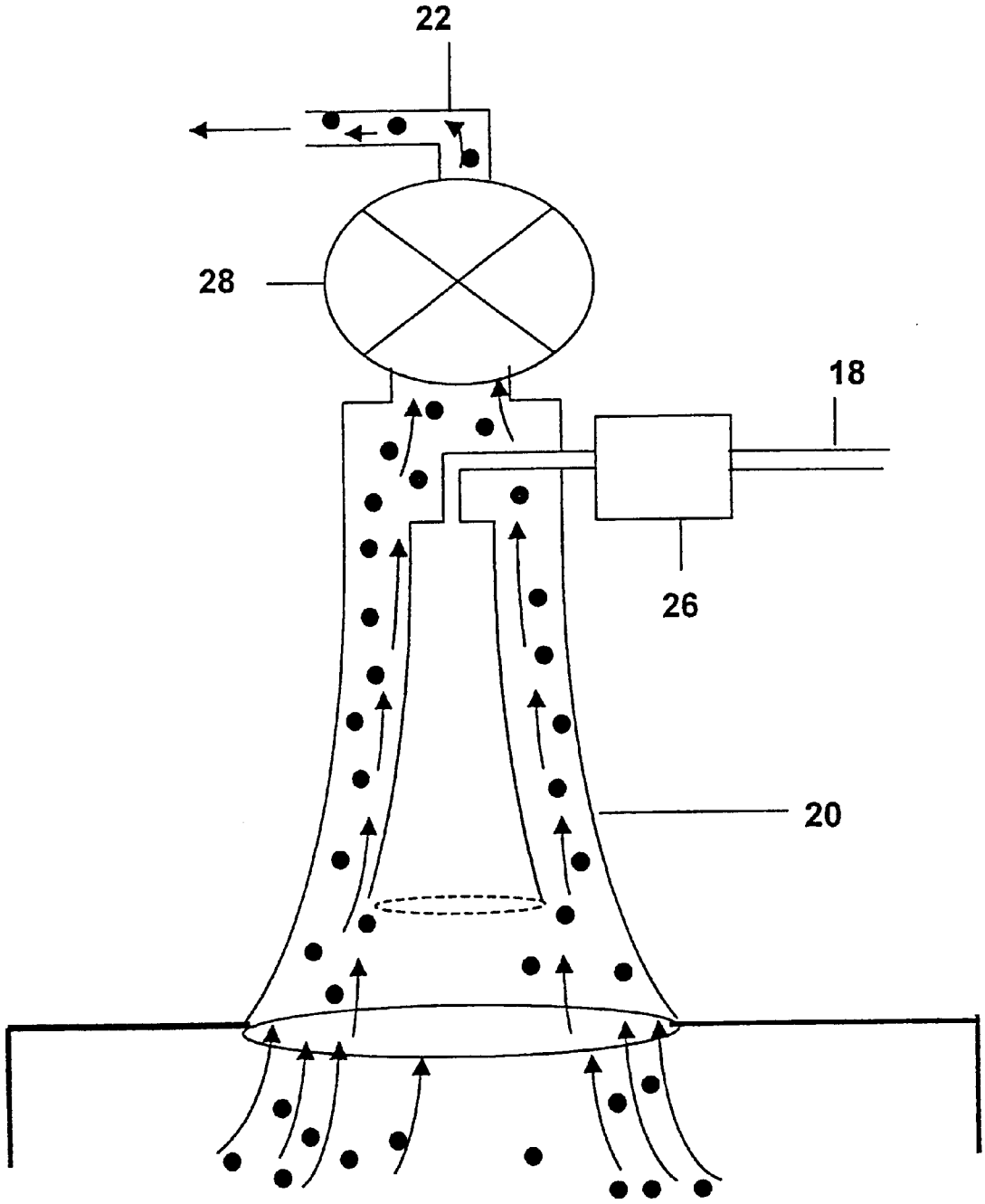
FIG. 4 is a diagrammatic view of the apparatus of FIG. 2 at the point in time of the extraction of $CO_2$ gas from the kneading container after the $CO_2$ snow introduction.

FIG. 4 shows the extraction of the $CO_2$ gas arising due to the cooling process after the end of the $CO_2$ snow injection into the container with the ventilator 28 in the extraction direction indicated by the arrows.

A temperature control means (not shown) for regulating the temperature of the container content regulates the temperature of the product to be cooled in the range from −30° C. and 60° C. by measuring the temperature of the container content at a corresponding drive of the solenoid valve 26 and, thus, the amount of added $CO_2$ snow. Using a partial oxygen pressure control means (not shown), the partial oxygen pressure in the head space of the kneading container 10 is regulated by measuring the partial oxygen pressure and corresponding drive of the ventilator 28 and, thus, extraction of a corresponding quantity of the $CO_2$ gas.

Figure 5:
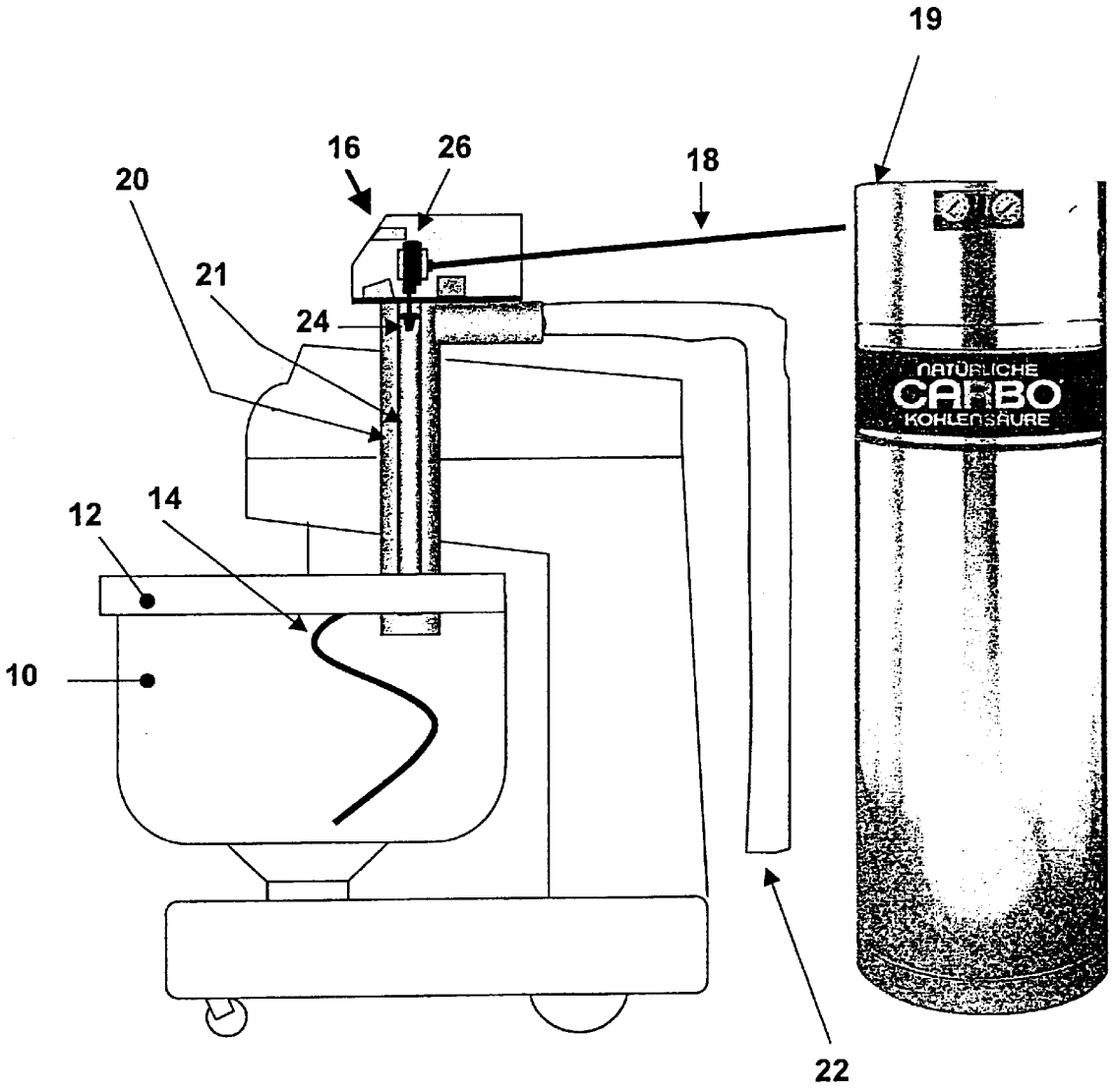
FIG. 5 is a schematic side view of a dough kneading machine with another specific embodiment of the inventive apparatus, whereby the kneading container of the dough kneading machine is shown to be transparent.
Figure 6:
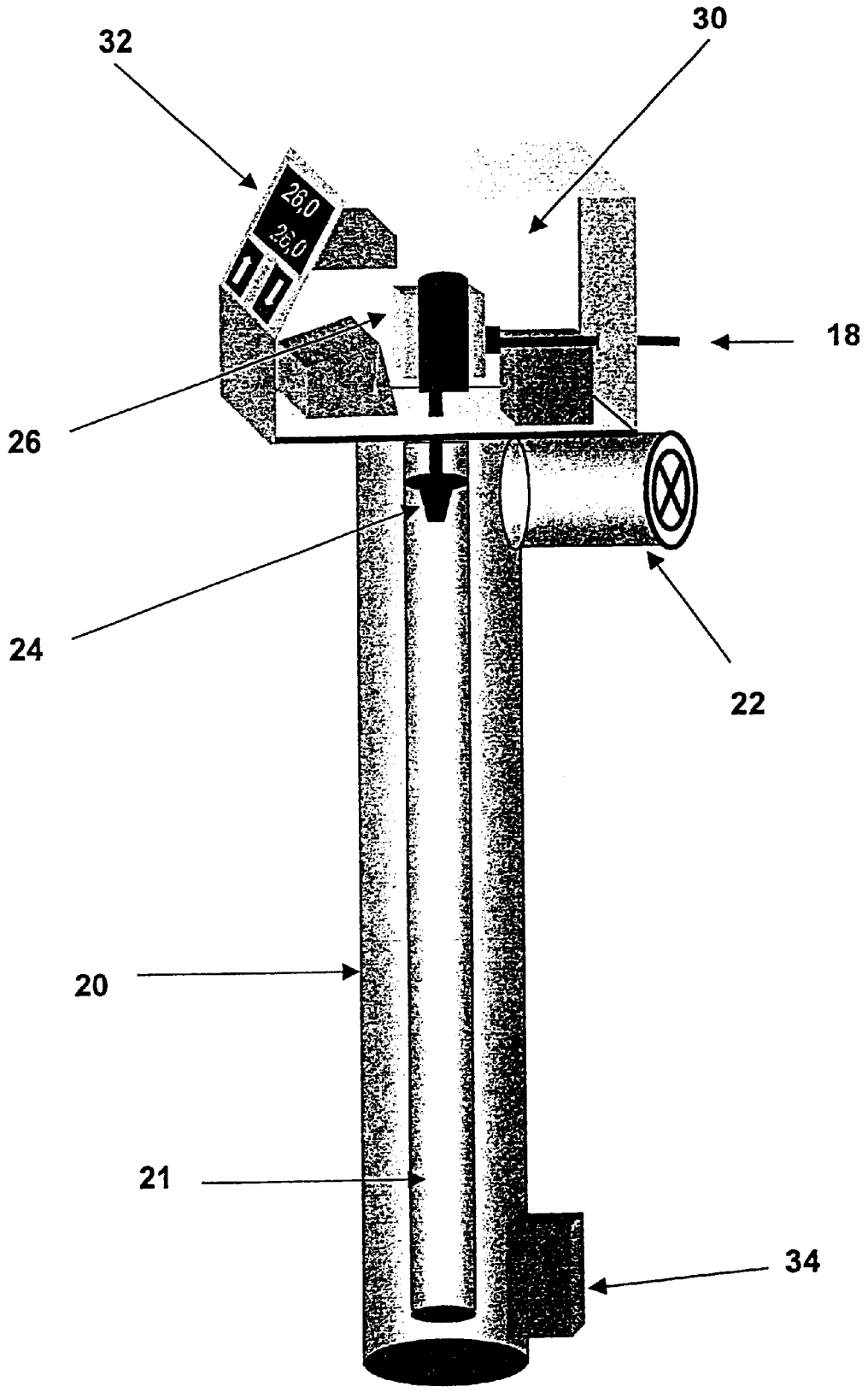
FIG. 6 is an enlarged perspective view of a portion of the apparatus of FIG. 5.

FIG. 5 shows a schematic illustration of a dough kneading machine with another specific embodiment of the inventive apparatus in a side view, whereby the kneading container of the dough kneading machine is shown to be transparent. The dough kneading machine comprises a kneading container 10, a container cover 12 and a kneading arm 14. The specific embodiment of the inventive apparatus 16 for introducing $CO_2$ into the kneading container 10 for cooling the dough is an integral component part of a switch box 30 (see FIG. 6) for a central control unit of the dough kneading machine. The apparatus 16 comprises a supply line 18 for delivery of the liquid $CO_2$ from a $CO_2$ container 19, an outer pipe or tube 20 with an inner snow pipe 21 for injecting the $CO_2$ snow generated in the apparatus 16 into the kneading container 10 as well as an exhaust gas conduit 22 for eliminating the $CO_2$ gas. The delivery of the liquid $CO_2$ is enabled or, respectively, prevented via a solenoid valve 26. The $CO_2$ snow formation is accomplished by a nozzle 24 in the form of a full jet nozzle. A control panel 32 serves the purpose of displaying the rated or, respectively, actual temperature of the dough as well as for setting the rated value thereof. Via a temperature sensor 34 in the form of an infrared temperature probe, the actual temperature of the dough during kneading is acquired. FIG. 6 shows these details.

For an efficient function of the apparatus 16, this must be attached to the container cover 12 of the kneading container 10 in such a way that the outer tube 20 has its dimensions projecting into the kneading container 10. The outer tube 20 dare not thereby come into contact with the kneading arm 14. The temperature sensor 34 should be mounted at the container cover 12 or, respectively, the outer tube 20 such that its infrared beam reaches only the surface of the dough and not that of the kneading arm 14 or, respectively, of the kneading container 10. This must also be assured given minimum of filling of the kneading container 10. Further, the temperature sensor 34 dare not come into contact with the dough.

The process-controlled dough cooling during kneading sequences as follows. The temperature of the dough (actual temperature) during kneading is constantly acquired via the temperature sensor 34. The actual temperature is compared to the desired dough temperature (rated temperature) that was manually input at the beginning of the kneading process via the control panel 32 of a control unit (not shown). The control unit controls the solenoid 26. Liquid $CO_2$ is introduced at the solenoid 26 via the supply line 18 in the form of a supply hose. Upon upward transgression of the rate temperature, the solenoid 26 is opened by the control unit, whereby the solenoid 26 remains closed given downward transgression of the rated temperature. When the solenoid 26 is opened, liquid $CO_2$ is thus injected via the nozzle 24 into the snow tube 21 until the rated temperature is again downwardly transgressed. This procedure is repeated several times, so that the rated temperature is retained until the end of kneading. The snow tube 21 conducts the $CO_2$ snow emerging from the nozzle 24 or, respectively, forming thereat directly into the kneading container 10, whereas the $CO_2$ gas, which is heavier then air is removed via the outer tube 20 with a ventilator (not shown) via an exhaust gas conduit 22. The ventilator comprising two power stages is likewise driven via the control unit. The first stage of the ventilator is characterized compared to the second stage of the ventilator by a lower extraction power. The ventilator is driven with low extraction power simultaneously with the opening of the solenoid 26. As a result of the low extracting power, the arising $CO_2$ gas in the injection phase is separated via the outer tube 20. For the extraction of the $CO_2$ gas subsequently formed from the $CO_2$ snow in the kneading container 10, the ventilator switches to the second stage given a simultaneously closed solenoid 26. The separated $CO_2$ gas and the subsequently formed $CO_2$ gas are thus conducted into the open with the ventilator via the exhaust gas conduit 22.

The apparatus 16 can be advantageously driven via the central control unit of the dough kneading machine. What is thus achieved is that the injection of the $CO_2$ snow only ensues after the mixing phase. This is expedient because the $CO_2$ snow in the mixing phase distributes only poorly in the dough. Further, the injection of the $CO_2$ snow can be ended simultaneously with or shortly before the end of the kneading time. This second version also assures a distribution of the $CO_2$ snow injected shortly before the end of the kneading time.

Two critical factors are of essential significance for the efficiency of the dough cooling with the inventive apparatus. First, this is dependent on the rate of the $CO_2$ snow formation that is achieved and, second, is dependent on separation of the $CO_2$ gas at the point in time of the $CO_2$ snow formation. The $CO_2$ snow formation rate and the separation are thereby dependent on a number of factors:

On the storage conditions of the liquid $CO_2$ in the supply tank: Preferably at a temperature around −20° C. and at a pressure around 19 bar.

It must be assured in the delivery of the liquid $CO_2$ from the supply tank to the nozzle that no premature $CO_2$ snow formation occurs due to a flow breakdown. This is achieved by the specific dimensions of the diameter of the supply hose, of the nominal width of the solenoid and of the bore of the nozzle. A diameter of 8 mm for the supply hose, a nominal width of 8 mm for the solenoid and a bore of 2.1 mm for the nozzle have proven advantageous.

the nozzle that is employed is distinguished by the production of a closed full jet and is referred to as a full jet nozzle in the technical field.

The ratio between the nozzle bore and the inside diameter of the snow tube and the length thereof, whereby an inside diameter of the snow tube of 40 mm and a length of the snow tube of 460 mm have proven advantageous.

The ratio between the length of the snow tube and the outer tube as well as the ventilator power regulate, among other things, the exit velocity of the $CO_2$ snow. The length of the snow tube preferably amounts to 460 mm, the length of the outer tube preferably amounts to 530 mm and the ventilator power during separation is low.

Both individually as well as in arbitrary combination, the features of the invention disclosed in the above specification, in the drawing as well as in the claims can be critical for realizing the various embodiments of the invention.

We claim:

1. An apparatus for the introduction of $CO_2$ snow into containers for cooling the container contents or the container, said apparatus comprising a $CO_2$ snow generating means for generating the $CO_2$ snow; a $CO_2$ snow injection means having a snow tube for injecting the generated $CO_2$ snow from a $CO_2$ delivery side into the container, said snow tube having an opposite side being connected to the $CO_2$ snow generating means; a $CO_2$ gas separating means for separating $CO_2$ gas and $CO_2$ snow in the region of the snow tube; and a $CO_2$ gas extraction means for extracting separated $CO_2$ gas, said $CO_2$ gas separating means comprising an outer tube surrounding the snow tube and arranged coaxially thereto, said outer tube projecting beyond the $CO_2$ snow delivery side of the snow tube in a longitudinal direction thereof and having an end being connected to the $CO_2$ gas extraction means in the region of the opposite side of the snow tube.

2. Apparatus according to claim 1, wherein the $CO_2$ snow generating means comprises a delivery means for conducting liquid $CO_2$ and comprises an evaporation means for the evaporation of the liquid $CO_2$.

3. Apparatus according to claim 2, wherein the evaporation means is arranged in the region of the opposite side of the snow tube.

4. Apparatus according to claim 2, wherein the evaporation means comprises a nozzle.

5. Apparatus according to claim 1, wherein both the snow tube and the outer tube end in a head space of the container.

6. Apparatus according to claim 1, wherein the snow tube and the outer tube are vertically arranged.

7. Apparatus according to claim 1, wherein the snow tube and the outer tube are arranged at such an angle that the $CO_2$ snow falls into the container.

8. Apparatus according to claim 1, wherein the snow tube is widened at the $CO_2$ snow delivery side.

9. Apparatus according to claim 8, wherein one of the snow tube and the outer tube is conically fashioned.

10. Apparatus according to claim 1, wherein the outer tube is widened at its end located at the $CO_2$ snow delivery side of the snow tube.

11. Apparatus according to claim 1, wherein the extraction means comprises a ventilator.

12. Apparatus according to claim 1, which includes a temperature control means for regulating the temperature of one of the container content and the container by injecting a corresponding quantity of $CO_2$ snow.

13. Apparatus according to claim 12, wherein the temperature control means comprises a rated temperature input means, a temperature sensor for measuring the actual temperature of the container content, a temperature comparison means for comparing the actual temperature to the rated temperature, and a drive means for driving a valve arranged in a supply line of the generating means.

14. Apparatus according to claim 1, which includes a partial oxygen pressure regulating means for regulating the partial oxygen pressure in a head space of the container by measuring the partial oxygen pressure and extracting a corresponding quantity of the $CO_2$ gas.

15. Apparatus according to claim 1, which includes a partial carbon dioxide pressure regulating means for regulating the partial carbon dioxide pressure in a head space of the container by measuring the partial carbon dioxide pressure and extracting a corresponding quantity of the $CO_2$ gas.

16. Apparatus according to claim 1, wherein the container is a container for kneading bread or cake dough.

17. An apparatus for the introduction of $CO_2$ snow into a container for cooling the container contents or the container, said container having a head space with an opening, said apparatus comprising a $CO_2$ snow generating means for generating the $CO_2$ snow, said generating means including a nozzle; a $CO_2$ snow injection means having a snow tube for injecting the generated $CO_2$ snow from a delivery end into the opening of the container, said snow tube having an opposite end being connected to the nozzle of the $CO_2$ snow generating means; a $CO_2$ gas separating means for separating $CO_2$ gas and $CO_2$ snow in the region of the snow tube; and a $CO_2$ gas extraction means for extracting separated $CO_2$ gas, said $CO_2$ gas separating means comprising an outer tube surrounding the snow tube and arranged coaxially thereto, said outer tube projecting beyond the delivery end of the snow tube in a longitudinal direction thereof and having an end being connected to the $CO_2$ gas extraction means in the region of the opposite end of the snow tube, and the $CO_2$ gas extracting means including a ventilator to positively remove the separated $CO_2$ gas.

18. Apparatus according to claim 17, which includes a partial oxygen pressure regulating means for regulating the partial oxygen pressure in the head space of the container by measuring the partial oxygen pressure and extracting a corresponding quantity of the $CO_2$ gas, so that a desired partial pressure of oxygen is maintained in the head space in the contents of the container.

19. Apparatus according to claim 17, which includes a partial carbon dioxide pressure regulating means for regulating the partial carbon dioxide pressure in the head space of the container by measuring the partial carbon dioxide pressure and extracting a corresponding quantity of the $CO_2$ gas, so that contents of the container are not exposed to an excess amount of $CO_2$ gas.

20. Apparatus according to claim 17, wherein both the outer tube and the snow tube extend through the opening into the container.

* * * * *